US007272918B2

(12) United States Patent
Epstein

(10) Patent No.: US 7,272,918 B2
(45) Date of Patent: Sep. 25, 2007

(54) SEALING GASKET FOR LOWER TOOL OF A SEALING STATION OF A VACUUM PACKAGING MACHINE

(76) Inventor: Moshe Epstein, 2536 Queensway, Northbrook, IL (US) 60062

( * ) Notice: Subject to any disclaimer, the term of this patent is extended or adjusted under 35 U.S.C. 154(b) by 57 days.

(21) Appl. No.: 11/354,655

(22) Filed: Feb. 16, 2006

(65) Prior Publication Data

US 2007/0186517 A1 Aug. 16, 2007

(51) Int. Cl.
*B65B 31/00* (2006.01)
*B65B 51/14* (2006.01)

(52) U.S. Cl. ..... 53/510; 53/329.3

(58) Field of Classification Search ..... 53/510, 53/511, 329.2, 329.3
See application file for complete search history.

(56) References Cited

U.S. PATENT DOCUMENTS 3,311,517 A * 3/1967 Keslar et al. ..... 156/104
3,750,362 A * 8/1973 Kishpaugh et al. ..... 53/433
3,832,828 A * 9/1974 Martin ..... 53/511
4,263,767 A * 4/1981 Kyle ..... 53/51
4,294,056 A * 10/1981 Paulsen et al. ..... 53/86
4,463,542 A * 8/1984 Greenawalt et al. ..... 53/479
4,951,444 A 8/1990 Epstein et al.
5,001,884 A * 3/1991 Hanagata ..... 53/58
5,271,207 A 12/1993 Epstein et al.
5,517,805 A 5/1996 Epstein
5,560,182 A * 10/1996 Garwood ..... 53/432

* cited by examiner

*Primary Examiner*—Stephen F. Gerrity

(57) ABSTRACT

An improved sealing gasket for a vacuum-sealing station of a vacuum packaging machine which is made such that the outer perimetric portion thereof is made of a greater hardness than the rest of the sealing gasket, whereby the sealing heat-elements of a reciprocal heating element only substantially contacts against the softer material of the sealing gasket, allowing this softer material to conform to the uneven or non-level condition of the heating element. In the preferred embodiment, the outer-most perimeter of the sealing gasket is made of a greater hardness in the approximate durometer-hardness range of between 60-85 Shore A, while the remainder of sealing gasket is made of less hardness in the approximate durometer-hardness range of between 30-50 Shore A.

20 Claims, 3 Drawing Sheets

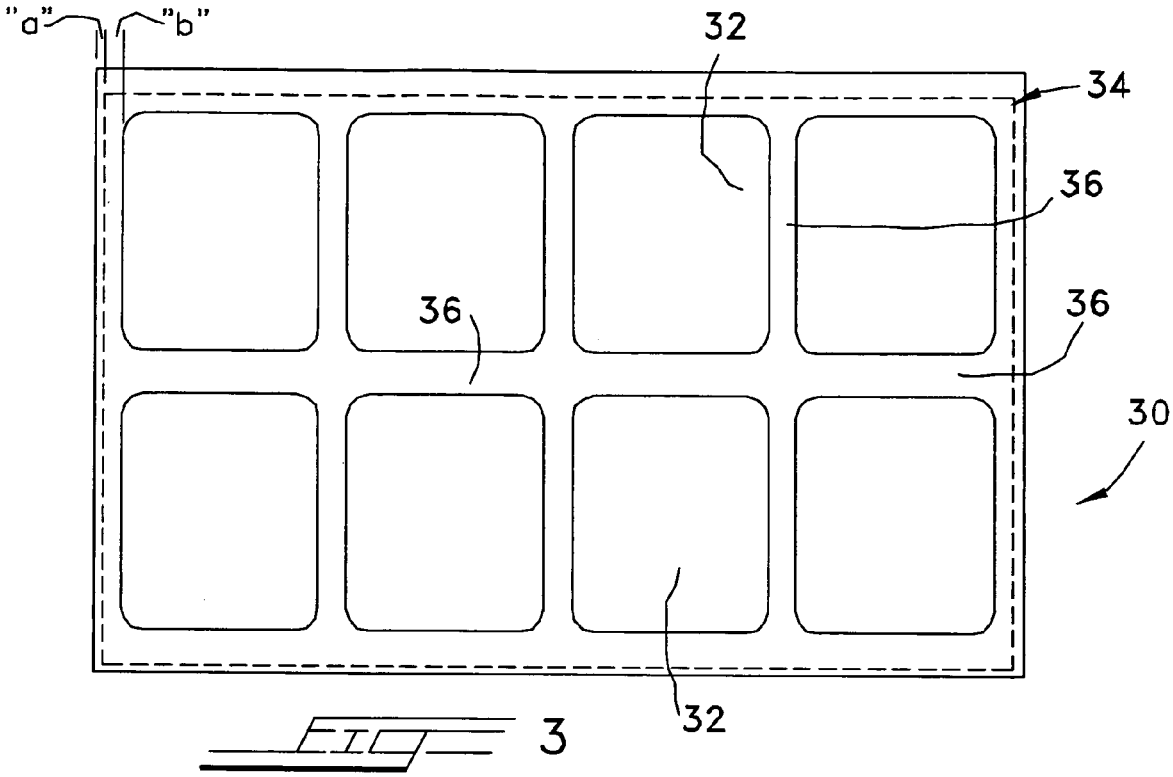
FIG 3
PRIOR ART
FIG 4
PRIOR ART
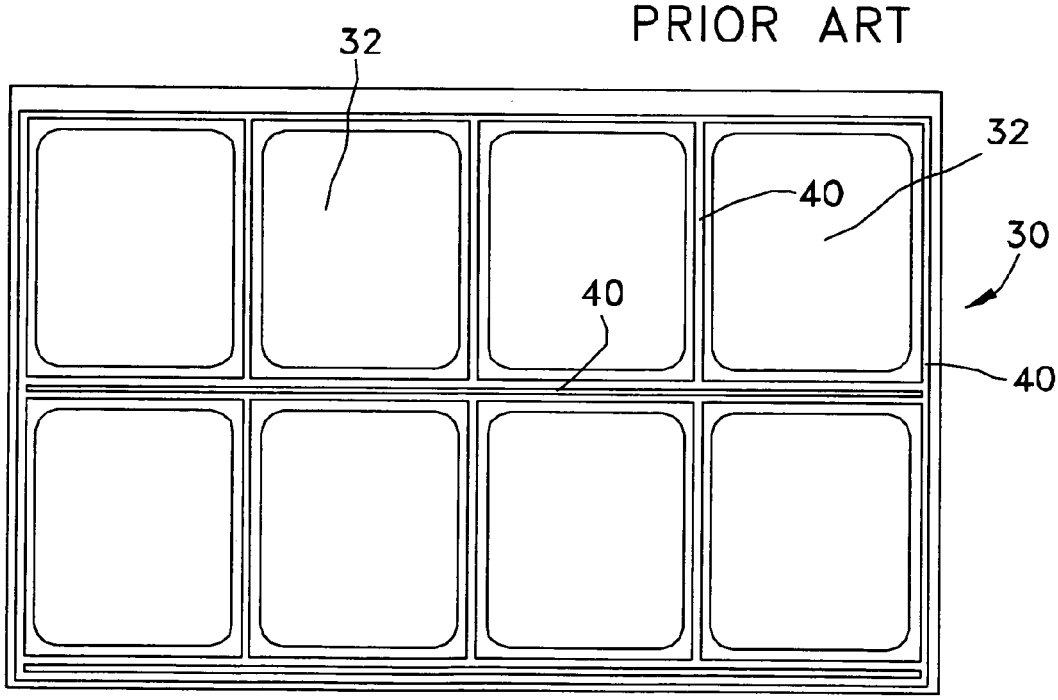

SEALING GASKET FOR LOWER TOOL OF A SEALING STATION OF A VACUUM PACKAGING MACHINE

BACKGROUND OF THE INVENTION

The present invention is directed to a sealing gasket for a sealing station of a vacuum packaging machine. An example of such a vacuum packaging machine is disclosed in U.S. Pat. No. 5,271,207, which reference is incorporated by reference herein. At the sealing station, the upper and lower film layers forming the horizontal row or rows of filled vacuum-packages are heat-sealed together via an upper heating tool after the rectangular-shaped lower and upper tools of the sealing station have been brought against each other, and after a vacuum has been formed in the each package of the row of packages. The heating tool is lowered toward the upper surface of the outer rim of the lower tool and is supported thereagainst by a sealing gasket mounted by a perimetric groove formed in the upper surface of the outer rim of the lower tool.

The sealing gasket is usually rectangularly-shaped, defining an outer rim and a plurality of inner ribs or cross-members corresponding to the number of packages in a row being formed on the vacuum packaging machine. The sealing gasket serves to seal the sealing station during the vacuum-forming process, and has the additional function of bearing the entire load of the upper tool when the upper and lower tools are brought into abutting contact when a vacuum is created and when the packages of the row or rows are heat-sealed via the reciprocal heating tool associated with the upper tool. The heating tool has a plurality of heating elements corresponding to the shape and number of packages of a row or rows of packages being formed by the vacuum-packaging machine.

The material of which the entire sealing gasket is usually made is silicone rubber, in the approximate durometer-hardness range of about 65-75 Shore A, although polyurethane in the same hardness range is also used. This hardness is required since this sealing gasket, as explained above, must bear the entire load of the upper tool. However, there are a number of problems associated with making the sealing gasket of such hard material. Since the heating elements are not perfectly level, especially over time and use, it is common that some packages are formed that are not adequately sealed by the heating tool because of this unevenness or non-levelness of the heating elements, which not only require that these defective packages be discarded, but also require that time be spent by the operators of the machine in order to check for and discard the defective packages and remove the contents of these defective packages. Presently-used techniques to try to overcome this tendency of forming defective packages have been to increase the force, or load, of the heating tool against the lower tool of the sealing station. While this method produces some benefit, it is only partially successful and requires ever-greater force or load as the heating tool becomes ever-more uneven or non-level, which leads to a shorter life of the heating element and related equipment and the sealing gasket.

It is, therefore, the primary objective of the present invention to provide an improved sealing gasket for a vacuum-sealing station of a vacuum packaging machine, which improved sealing gasket overcomes the above-mentioned problems associated with the common occurrence of producing defective packages owing to the unevenness, or non-levelness, of the heating element.

SUMMARY OF THE INVENTION

It is, therefore, the primary objective of the present invention to provide an improved sealing gasket for a vacuum-sealing station of a vacuum packaging machine, which substantially eliminates the production of defective packages owing to the unevenness, or non-levelness, of the heating element.

It is, also, the primary objective of the present invention to provide an improved sealing gasket for a vacuum-sealing station of a vacuum packaging machine, which substantially eliminates the production of defective packages, and which substantially eliminates the need to provide ever-greater loading of the heating tool, over time and use, against the lower tool of the sealing station.

Toward these and other ends, the improved sealing gasket for a vacuum-sealing station of a vacuum packaging machine is made such that the outer perimetric portion thereof that supports the upper tool is made of a greater hardness than the rest of the sealing gasket, whereby the sealing heat-elements of the heating tool only substantially contact against the softer material of the sealing gasket, allowing this softer material to conform to the uneven or non-level condition of the heating elements.

In the preferred embodiment, the outer-most perimeter of the sealing gasket is made of a greater hardness in the approximate durometer-hardness range of between 60-85 Shore A, while the remainder of sealing gasket is made of less hardness in the approximate durometer-hardness range of between 30-50 Shore A.

BRIEF DESCRIPTION OF THE DRAWINGS

The invention will be more readily understood with reference to the accompanying drawings, wherein:

FIG. 3 is a top view of the sealing gasket of FIG. 1; and

FIG. 4 is a bottom view thereof.

DETAILED DESCRIPTION OF THE INVENTION

Figure 1:
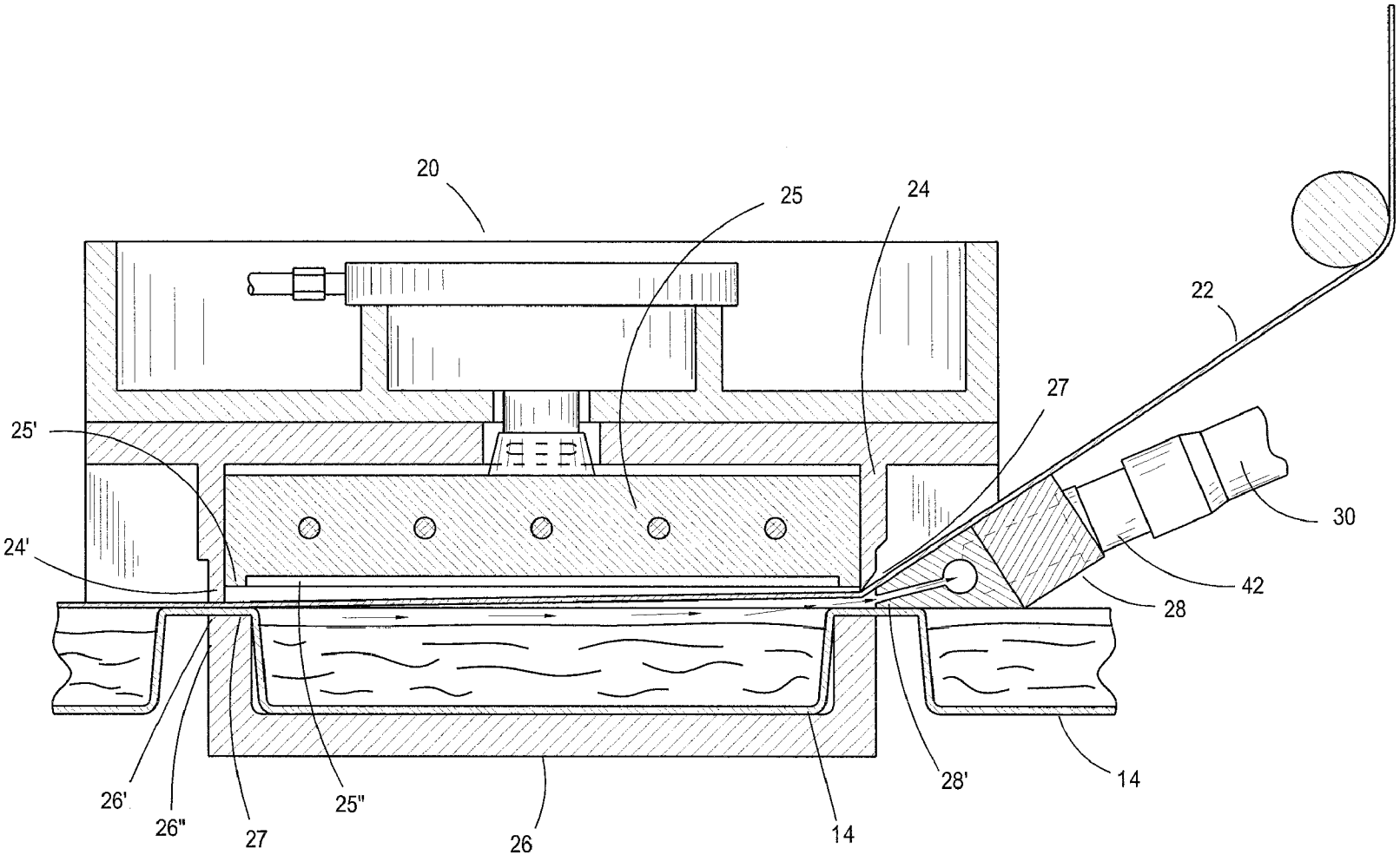
FIG. 1 PRIOR ART
FIG. 1 is a vertical cross-sectional view of a prior art sealing station of a conventional vacuum packaging machine at which a sealing gasket is used in accordance with the present invention.

Referring now to the drawings in greater detail, in FIG. 1 there is shown a prior-art sealing station 20 of a conventional vacuum packaging machine, such as that disclosed in U.S. Pat. No. 5,271,207, which reference is incorporated by reference herein, at which a sealing gasket is used in accordance with the present invention. The sealing station 20 consists of a supply roll 22 of a plastic film 24 constituting the upper layer of the finished vacuum packages and is unrolled to a location juxtapositioned above the product-filled pocket-receptacles. At the sealing station, the upper film is heat-sealed to the lower film, during which sealing a vacuum is formed in the packages via a nozzle-head 28. The sealing station has an upper tool 24 in which is mounted for relative movement a heating tool 25, which heating tool has a lower projecting perimetric, or peripheral, heating element 25' and one or more transverse heating elements 25", depending upon the number of vacuum packages in a row or rows that are being heat-sealed at the sealing station. The upper tool abuts against a lower tool 26 when the upper and lower tools are brought into abutting contact against each other during the sealing process, with upper and lower tools holding the upper film and lower films, respectively, by suction. Either the upper tool 24 or lower tool 26 may be movable toward the other, with the other usually being stationary. The number and rows of vacuum packages being sealed at the sealing station will vary depending upon the product. For example, there may be two rows of four vacuum packages being heat sealed at the sealing station. The lower tool will have the appropriate mold configuration depending upon the number of rows and number of packages per row. For purposes of this description, it will be assumed that there are two rows of four vacuum packages being heat sealed at the sealing station, although different arrangements are, or course, possible by changing the lower tool 25, as is well-known.

The upper tool has a lower projecting perimetric, or peripheral, rim 24' that is supported by a corresponding portion 26' of an upper projecting perimetric, or peripheral, rim 26". The width of the lower projecting peripheral, rim 24' is less than the width of upper projecting peripheral, rim 26", so that only the portion or section 26' of the upper projecting rim 26" bears the load thereof during the heat-sealing process. The lower projecting heating element 25' of the heating tool during the heat sealing process bears against an inner portion or section 27 of the peripheral rim 26" of the lower tool. Thus, the upper projecting rim 26" has a width that accommodates and bears the load of both the upper tool and heating tool via the contact of the projecting rim 24' and heating element 25' of the upper tool and heating tool, respectively, against the upper projecting rim 26". In order to provide a vacuum seal at the sealing station between the upper tool and heating element, and the lower tool, there is provided a sealing gasket having the same general cross-sectional shape and configuration as the lower tool and which is mounted to the upper projecting rim 26" via a groove or grooves formed in the upper projecting rim 26", which receive downwardly-projecting ribs of the sealing gasket, as will be explained further hereinbelow. For purposes of clarity, the sealing gasket has not been shown in FIG. 1. The sealing gasket is sandwiched between the upper projecting rim 26" of the lower upper tool and downwardly-projecting rims 24', 25' of the upper tool and heating tool, respectively. Thus, the sealing gasket bears the high load of the upper tool while also supporting the heating tool during the heat-sealing process.

Figure 2:
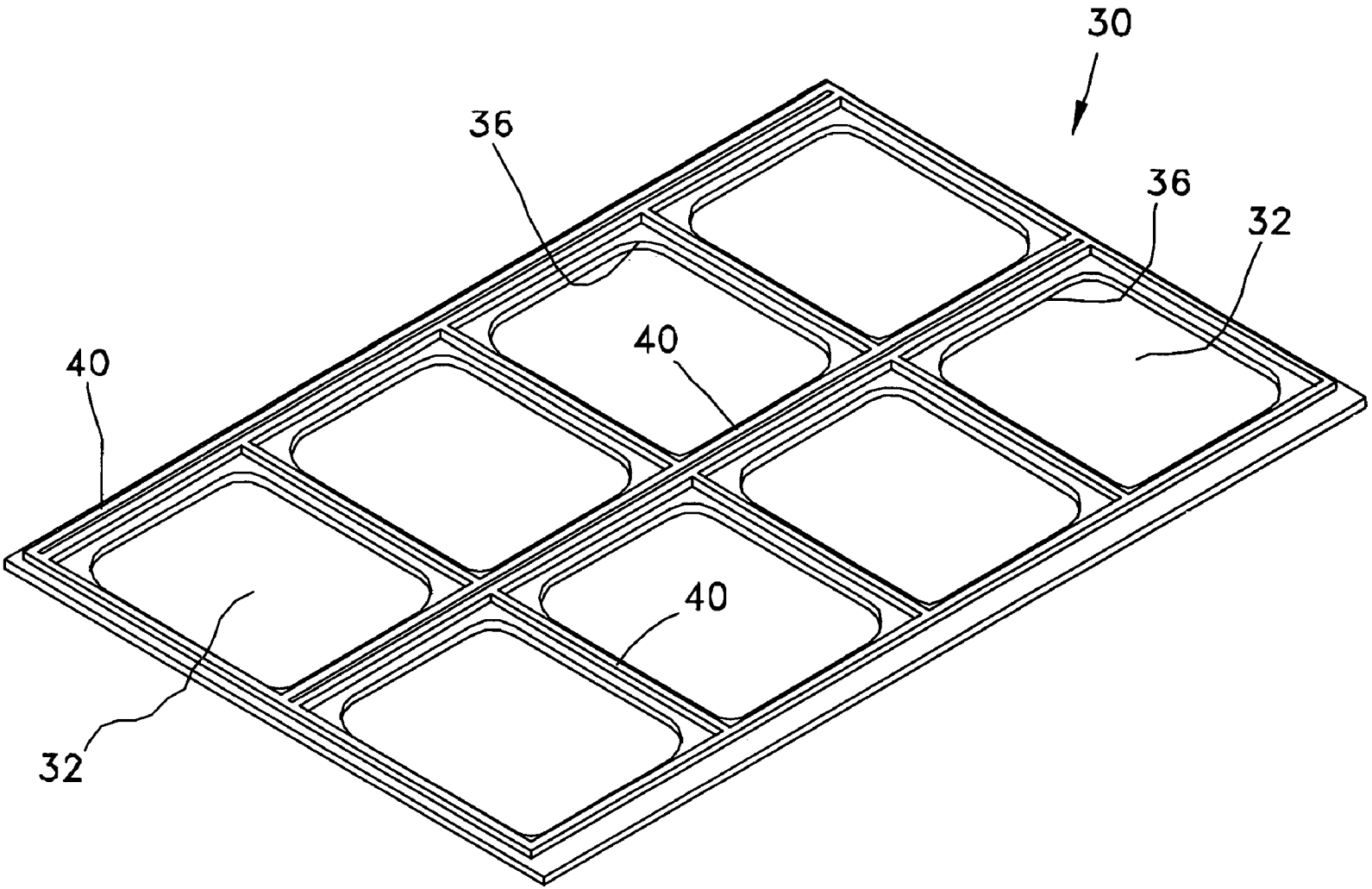
FIG 2 PRIOR ART
FIG. 2 is a bottom isometric view of a conventional sealing gasket used at the sealing station of a conventional vacuum packaging machine of FIG. 1.

Referring now to FIGS. 2-4, there is shown a typical prior-art sealing gasket 30 that may be used in the sealing station 20 of FIG. 1. Any sealing gasket 30 will have a cross-sectional shape and configuration similar to that of the lower tool of the sealing station. For purposes of description, it has been assumed that the sealing station will seal two rows of packages, with each row containing four packages. Therefore, the sealing gasket, like the lower tool of the sealing station, is provided with two rows of four openings 32. The sealing gasket has an outer perimetric or peripheral rim section 34 and interior connecting sections or cross-members 36 that together define voids that form the two rows of four openings 32. The width of the outer perimetric or peripheral rim section 34 is substantially the same as the width of the upper projecting perimetric rim 26" of the lower tool 26. Thus, a first outer section of width "a" of the outer perimetric or peripheral rim section 34 of the sealing gasket 30 corresponds to the outer section 26' of the upper projecting perimetric rim 26" of the lower tool 26 of FIG. 1, while a second inner section of width "b" corresponds to the inner section 27 of the upper projecting perimetric rim 26" of the lower tool 26 of FIG. 1. Therefore, the outer section of width "a" of the outer perimetric rim section 34 of the sealing gasket 30 bears the load of the lower projecting perimetric rim 24' of the upper tool 24 of FIG. 1, while the second inner section of width "b" of the outer perimetric rim section 34 of the sealing gasket 30 bears the load of the lower projecting perimetric heating element 25' of the heating tool 25 of FIG. 1 during the sealing and forming process.

The sealing gasket is also provided with downwardly-projecting ribs 40 for reception in a groove or grooves formed in the upper projecting perimetric, or peripheral, rim 26" of the lower tool 26, as described hereinabove, and also for reception in corresponding cross-members of the lower tool corresponding to the interior connecting sections or cross-members 36, so that the downwardly-projecting ribs 40 are received therein whereby the sealing gasket is mounted to the lower tool.

Prior-art sealing gaskets 30 are typically made entirely of silicone rubber in the approximate durometer-hardness range of about 75-85 Shore A, although polyurethane in the same hardness range is also used. This hardness is required since this sealing gasket must bear the entire load of the upper tool, as described hereinabove. In accordance with the present invention, the first outer section of width "a" of the outer perimetric rim section 34 of the sealing gasket 30 is made of a durometer hardness greater than the second inner section of width "b" of the outer perimetric rim section 34 of the sealing gasket 30 and greater than the interior connecting sections or cross-members 36. Since the other sections of the sealing gasket other than the first outer section of width "a" of the outer perimetric rim section 34 of the sealing gasket 30 only bear the load of the heating tool 25, which is considerably less than that required for the upper tool, these other sections of the sealing gasket need not be of such a great hardness. Therefore, by making these other sections of less hardness, they are more resilient, compliant, and elastic so as to better conform and adapt to the shape of the heating elements 25' and 25" of the heating tool 25 shown in FIG. 1. As explained above, owing to the irregularities in the level of the heating elements, which especially occurs over time and use, it has been common when using the prior-art sealing gaskets to have packages that have been improperly sealed. By making these other sections of the sealing gasket other than the first outer section of width "a" of the outer perimetric rim section 34 relatively softer, the irregularities and non-level conditions of the heating elements are much better accommodated, thus preventing improper heat-sealing by these heating elements of the upper layer of film to the lower layer of film, since these softer sections will more readily conform to the irregular shape and non-level condition of the downwardly-projecting heating elements 25', 25".

In the preferred embodiment, the first outer section of width "a" of the outer perimetric rim section 34 of the sealing gasket has a durometer hardness range of approximately between 60-85 Shore A, while the remainder of the sealing gasket 32 including the second inner section of width "b" of the outer perimetric or peripheral rim section 34 and the interior connecting sections or cross-members 36, is a durometer hardness in the approximate range of between 30-50 Shore A. Concerning the mounting ribs 40, they may be made of a hardness the same as the first outer section of width "a" of the outer perimetric rim section 34, or of a hardness the same as the remainder of the sealing gasket 32, or even of a different hardness. It is also possible to make the mounting ribs themselves of different hardness, as long as they are softer than that of the first outer section of width "a"

of the outer perimetric rim section 34. In one preferred embodiment, the outer perimetric rim section is a perimetric band approximately in the range of between one-quarter to three-eighth of an inch, depending upon the width of the downwardly-projecting lower perimetric rim 24'.

While a specific embodiment of the invention has been shown and described, it is to be understood that numerous changes and modifications may be made therein without departing from the scope and spirit of the invention.

What is claimed is:

1. In a vacuum packaging machine comprising a sealing station consisting of a lower tool, an upper tool having a downwardly-projecting lower perimetric rim, and a reciprocal heating tool operatively associated with said upper tool having downwardly-projecting heating means, said lower tool having an upwardly-projecting upper perimetric rim consisting of an outer section against which said downwardly-projecting lower perimetric rim of said of upper tool is loaded during the sealing process and an inner section against which at least a portion of said downwardly-projecting heating means of said heating tool is loaded during the heat-sealing operation, mounting means in said upwardly-projecting upper perimetric rim of said lower tool, and sealing gasket means having a perimetric shape corresponding to said upwardly-projecting upper perimetric rim of said lower tool and defining an inner perimetric portion and an outer perimetric portion and comprising rib means extending downwardly from the bottom surface thereof for reception in said mounting means of said upwardly-projecting upper perimetric rim of said lower tool for providing a vacuum seal when said lower and upper tools are brought into abutting operational contact with each other, said sealing gasket means being sandwiched between said upwardly-projecting upper perimetric rim of said lower tool and said downwardly-projecting lower perimetric rim of said upper tool and said downwardly-projecting heating means of said heating tool during said sealing operation, the improvement comprising:

said sealing gasket means comprising a first perimetric section of a first durometer hardness, and second section of a second durometer hardness less than said first durometer hardness;

said first perimetric section comprising said outer perimetric portion of said sealing gasket means against which said downwardly-projecting lower perimetric rim of said upper tool abuts, and said second section comprising said inner perimetric portion of said sealing gasket means against which said downwardly-projecting heating means of said heating tool abuts during the sealing process.

2. The improvement according to claim 1, wherein said first durometer hardness is in the approximate range of between 60-85 Shore A, and said second durometer hardness is in the approximate range of between 30-50 Shore A.

3. The improvement according to claim 1, wherein said outer perimetric portion is the outermost portion thereof.

4. The improvement according to claim 3, wherein said outermost perimetric portion is a perimetric band approximately in the range of between one-quarter to three-eighth of an inch.

5. The improvement according to claim 4, wherein said first durometer hardness is in the approximate range of between 60-85 Shore A, and said second durometer hardness is in the approximate range of between 30-50 Shore A.

6. The improvement according to claim 5, wherein said second section comprises the remainder of said sealing gasket means other than said first section.

7. The improvement according to claim 4, wherein said sealing gasket means is made of one of: silicone rubber, polyurethane or a combination thereof.

8. The improvement according to claim 1, wherein said second section comprises the remainder of said sealing gasket means other than said first section.

9. The improvement according to claim 1, wherein said lower tool further comprises a plurality of inner support members for supporting corresponding portions of said downwardly-projecting heating means of said heating tool, said plurality of inner support members corresponding to the specific formation and arrangement of a row of vacuum packages being sealed at said sealing station; said sealing gasket means further comprising a plurality of inner members corresponding to said plurality of inner support members of said lower tool; said second section of said second durometer hardness also comprising said plurality of inner members of said sealing gasket means.

10. The improvement according to claim 9, wherein said sealing gasket means further comprises a plurality of downwardly-extending rib members, one said rib member projecting from a respective one said inner member for mounting a respective said inner member of said inner support members; said second section of said second durometer hardness also comprising said plurality of downwardly-extending rib members.

11. The improvement according to claim 10, wherein said outer perimetric portion is the outermost portion thereof.

12. The improvement according to claim 11, wherein said second section comprises the remainder of said sealing gasket means other than said first section.

13. The improvement according to claim 9, wherein said first durometer hardness is in the approximate range of between 60-85 Shore A, and said second durometer hardness is in the approximate range of between 30-50 Shore A.

14. The improvement according to claim 13, wherein said outermost perimetric portion is a perimetric band approximately in the range of between one-quarter to three-eighth of an inch about said upper perimetric rim of said sealing gasket.

15. The improvement according to claim 9, wherein said second section comprises the remainder of said sealing gasket means other than said first section.

16. In a sealing gasket for a sealing station a vacuum packaging machine, the sealing station consisting of a lower tool, an upper tool having a downwardly-projecting lower perimetric rim, and a reciprocal heating tool operatively associated with the upper tool having downwardly-projecting heating means, the lower tool having an upwardly-projecting upper perimetric rim consisting of an outer section against which the downwardly-projecting lower perimetric rim of the upper tool is loaded during the sealing process and an inner section against which at least a portion of the downwardly-projecting heating means of the heating tool is loaded during the heat-sealing operation, a sealing gasket having a perimetric shape corresponding to the upwardly-projecting upper perimetric rim of the lower tool and defining an inner perimetric portion and an outer perimetric portion and comprising mounting means extending downwardly from the bottom surface thereof for mounting to the lower tool for providing a vacuum seal when the lower and upper tools are brought into abutting operational contact with each other, said sealing gasket being sandwiched between the upwardly-projecting upper perimetric rim of the lower tool and the downwardly-projecting lower perimetric rim of the upper tool and the downwardly-projecting heating means of the heating tool during the sealing operation, the improvement comprising:

a first perimetric section of a first durometer hardness, and a second section of a second durometer hardness less than said first durometer hardness;

said first perimetric section comprising said outer perimetric portion of said sealing gasket against which the downwardly-projecting lower perimetric rim of the upper tool abuts, and said second section comprising said inner perimetric portion of said sealing gasket against which the downwardly-projecting heating means of the heating tool abuts during the sealing process.

17. The improvement according to claim 16, wherein said first durometer hardness is in the approximate range of between 60-85 Shore A, and said second durometer hardness is in the approximate range of between 30-50 Shore A.

18. The improvement according to claim 16, wherein said second section comprises the remainder of said sealing gasket other than said first section.

19. The improvement according to claim 16, wherein the lower tool further comprises a plurality of inner support members for supporting corresponding portions of the downwardly-projecting heating means of said heating tool, the plurality of inner support members corresponding to the specific formation and arrangement of a row of vacuum packages being sealed at the sealing station; said sealing gasket further comprising a plurality of inner members corresponding to the plurality of inner support members of the lower tool; said second section of said second durometer hardness also comprising said plurality of inner members of said sealing gasket.

20. The improvement according to claim 16, wherein said outermost perimetric portion is a perimetric band approximately in the range of between one-quarter to three-eighth of an inch about said upper perimetric rim of said sealing gasket.

* * * * *